US006213793B1

(12) United States Patent
Norizuki et al.

(10) Patent No.: US 6,213,793 B1
(45) Date of Patent: Apr. 10, 2001

(54) CONNECTOR

(75) Inventors: Teruhisa Norizuki; Shinji Kodama, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/281,057

(22) Filed: Mar. 10, 1999

(30) Foreign Application Priority Data

Mar. 10, 1998 (JP) ..... 10-058581

(51) Int. Cl.[7] ..... H01R 13/62
(52) U.S. Cl. ..... 439/157
(58) Field of Search ..... 439/761, 686, 439/159, 372, 157, 374

(56) References Cited

U.S. PATENT DOCUMENTS 5,975,929 * 11/1999 Matsuura et al. ..... 439/157
6,030,236 * 2/2000 Matsuura et al. ..... 439/157

FOREIGN PATENT DOCUMENTS

11162559 * 6/1999 (JP) .

* cited by examiner

*Primary Examiner*—Lincoln Donovan
*Assistant Examiner*—Chandrika Prasad
(74) *Attorney, Agent, or Firm*—Sughrue, Mion, Zinn, Macpeak & Seas, PLLC

(57) ABSTRACT

A connector in which a lever which is turned depending upon the reciprocation of one connector housing is supported so that the lever can be turned by a cover inside which the one connector housing is provided so that it can be reciprocated, being slid, the halfway portion of the lever is linked with the point of application of the one connector housing and the end of the lever can be fitted to the fitting portion of the other connector housing when both connector housings are engaged. In the connector, a lever extruding portion to which the halfway portion of the lever is touched is protruded from the one connector housing in its state waiting for engagement and an interval between the point of application and the lever extruding portion is set so that it is small.

6 Claims, 16 Drawing Sheets

CONNECTOR

BACKGROUND OF THE INVENTION

1. Field of the Invention

The present invention relates to a connector suitable for smoothly engaging or disengaging both male and female multipolar connector housings.

2. Description of the Related Art

Briefly explaining an example of this type of connector, referring to FIGS. 19 and 20, a male connector housing 2 made of synthetic resin of a connector 1 is covered with a slide cover 3 so that the slide cover can be slid on the male connector housing. A base 4*a* of a lever 4 which is turned depending upon the reciprocation of the slide cover 3 is supported on each of both sides of the upper wall of the slide cover 3 so that the base can be turned via a spindle 3*a* for a point of the lever where force is applied. A halfway portion 4*b* of the lever 4 is fitted to each guide portion (point of application) 5 on both sides of the male connector housing 2 and an end 4*c* of the lever 4 can be fitted to a rib (fitting portion) 8 of a female connector housing 7 made of synthetic resin when both the male and female connector housings 2 and 7 are engaged.

As shown in FIG. 20, the slide cover 3 is formed in the size of a rectangular cylinder for covering the male connector housing 2 and an extended portion 3*b* for covering each of both sides of the male connector housing 2 is protruded from each side wall. Hereby, the center on the front side of each of the upper and lower walls of the slide cover 3 is notched in the shape of a rectangle. (The notched portion in FIG. 20 is designated by reference numeral 3*c*.)

As shown in FIG. 19, a temporarily fitted state in which the lever 4 is tilted between a protrusion 5*a* of the guide portion 5 of the male connector housing 2 and a tapered surface 6*a* of a lever extruding portion 6 is equivalent to a state waiting for engagement of the male connector housing 2 in the slide cover 3, when the slide cover 3 inside which the male connector housing 2 is temporarily fitted is extruded inside a hood 7*a* of the female connector housing 7 from the above state, the end of the lever 4 comes in contact with a protrusion 8*a* for supporting a lever of the rib 8 of the hood 7*a* of the female connector housing 7 and the lever 4 begins to turn, and when the slide cover 3 is further extruded in an engaged direction, the male connector housing 2 is pulled inside the hood 7*a* of the female connector housing 7 by the action of the lever 4 (leverage with the spindle 3*a* for supporting the base 4*a* of the lever 4 so that the base can be turned as a point where force is applied, the protrusion 5*a* of the guide portion 5 of the male connector housing 2 as a point of application and the protrusion 8*a* of the rib 8 of the female connector housing 7 as a fulcrum) and both connector housings 2 and 7 are engaged.

In the above connector 1 according to the related art, a state waiting for engagement of the male connector housing 2 in the slide cover 3 is kept by tilting the lever 4 between the protrusion 5*a* of the guide portion 5 on both sides of the male connector housing 2 and the tapered surface 6*a* of the lever extruding portion 6, however, as an interval between the guide portion 5 of the male connector housing 2 and the lever extruding portion 6 is large, the leverage of the lever 4 does not function in a range of the play of the lever 4 and the lever is in the range of the play of the lever 4 when both connector housings 2 and 7 are disengaged, it is difficult to disengage both connector housings 2 and 7 by small force.

SUMMARY OF THE INVENTION

The present invention was made to solve the above problem and an object thereof is to provide a connector wherein both male and female connector housings can be readily disengaged using the leverage of a lever which is turned by small force even when both connector housings are disengaged.

In order to achieve the above object, the present invention provides a connector comprising: a male connector housing; a female connector housing; a cover in which one of the male and female connector housings is provided so that the one can be reciprocated, being slid; and a lever which is turned depending upon the reciprocation of the one connector housing, a base of the lever being supported by the cover so that the lever can be turned, a halfway portion of the lever being linked with a point of application of the one connector housing and an end of the lever being fitted to a fitting portion of the other connector housing when the both connector housings are engaged, wherein a lever extruding portion to which the halfway portion of the lever is touched in a state waiting for engagement of the one connector housing is protruded from the one connector housing, and an interval between the lever extruding portion and the point of application is set to be small.

DETAILED DESCRIPTION OF THE PREFERRED EMBODIMENT

Referring to the accompanying drawings, an embodiment of the present invention will be described below.

Figure 1:
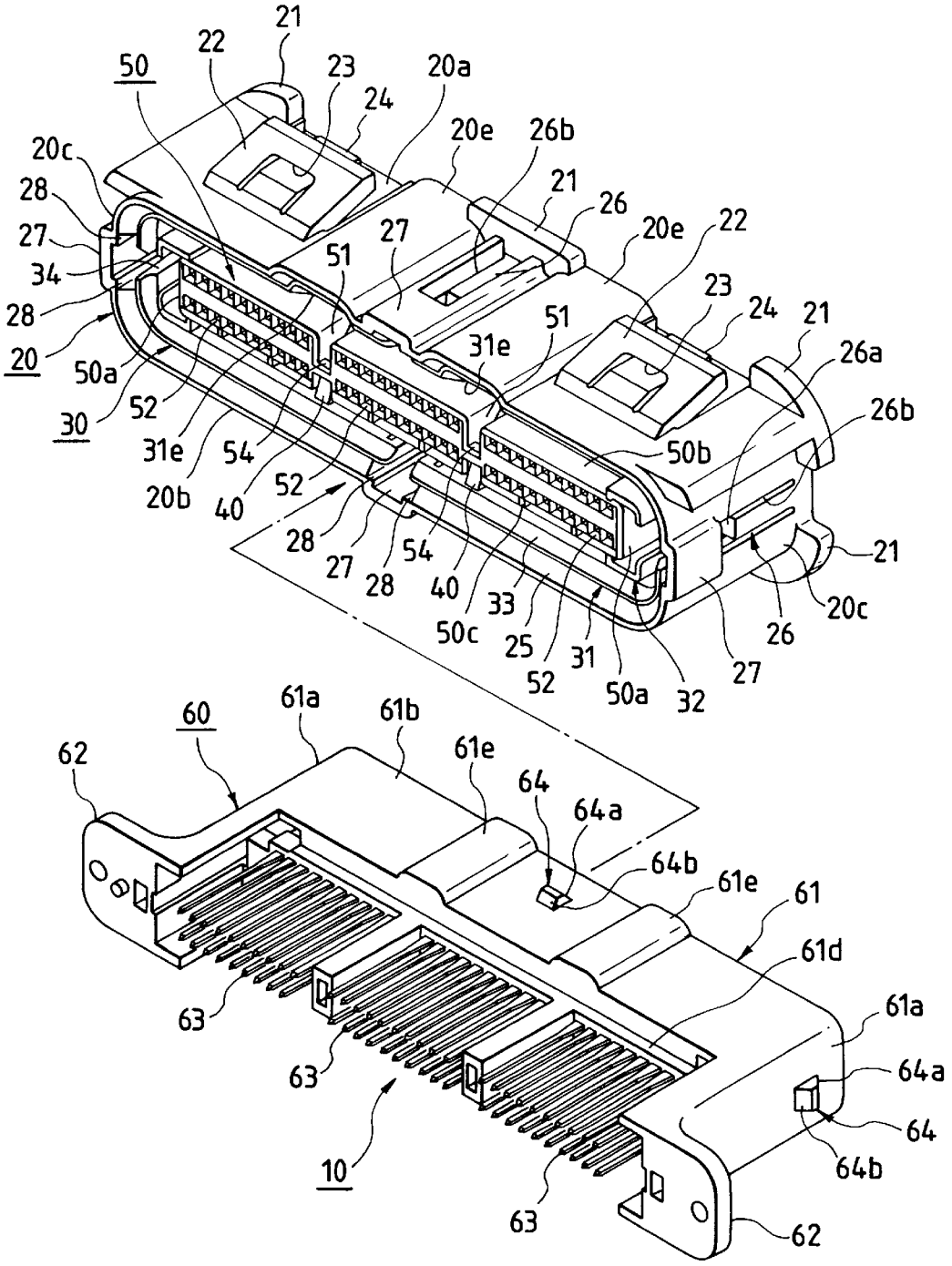
FIG. 1 is a perspective view showing a state before both male and female connector housings composing a connector according to an embodiment of the present invention are engaged.
Figure 2:
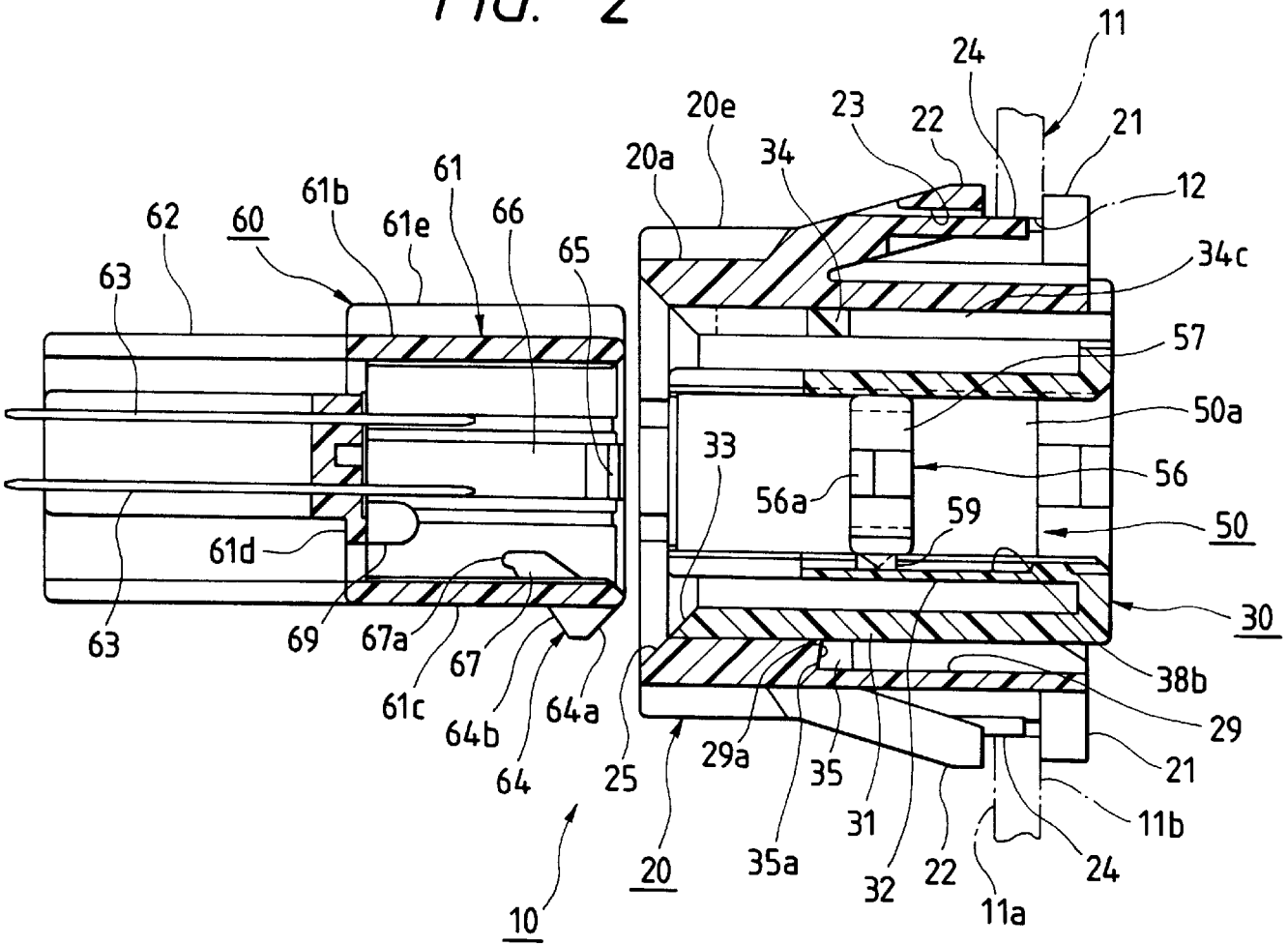
FIG. 2 is a sectional view showing the state before the male and female connector housings are engaged.
Figure 3:
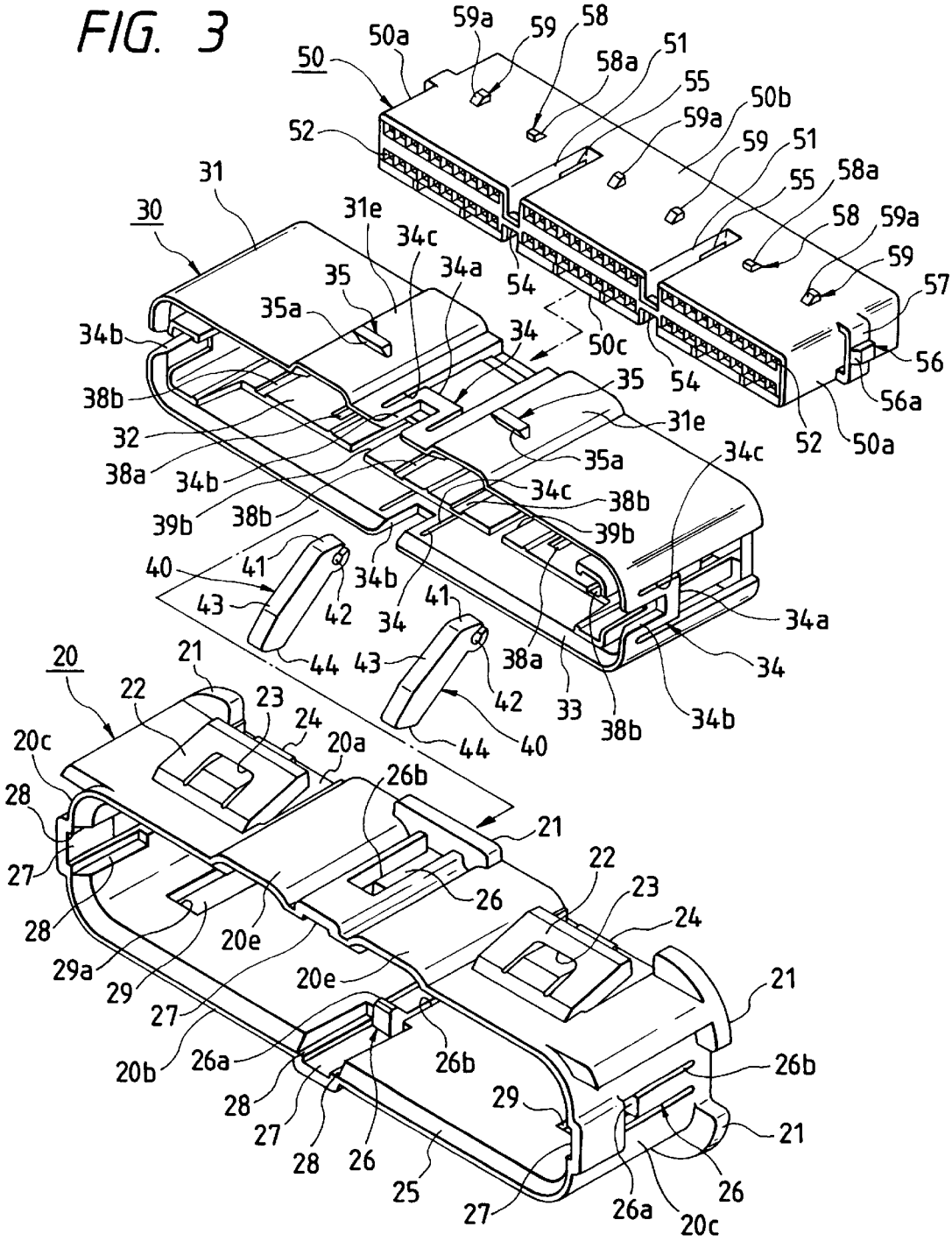
FIG. 3 is an exploded perspective view showing the male connector housing.
Figure 4:
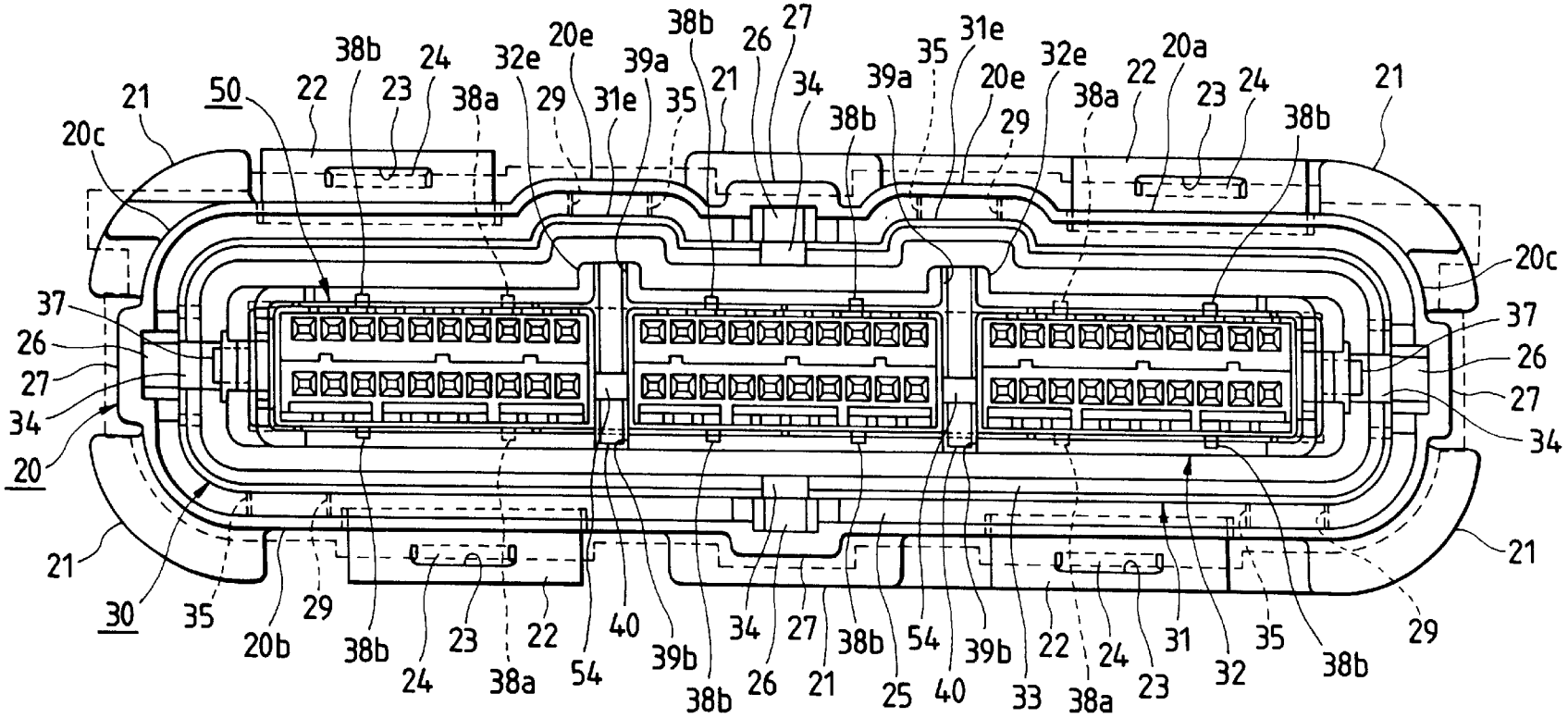
FIG. 4 is a front view showing the male connector housing.

FIG. 1 is a perspective view showing a state before male and female connector housings composing a connector according to an embodiment of the present invention are engaged, FIG. 2 is a sectional view showing the same state, FIG. 3 is an exploded perspective view showing the male connector housing in the same state and FIG. 4 is a front view showing the male connector housing in the same state. In the drawings, the respective engaged sides of both the male and female connector housings shall be the front sides.

As shown in FIGS. 1 to 3, a connector 10 is composed of a holder 20 formed substantially in the shape of a rectangular cylinder which is made of synthetic resin and which is attached to a mounting hole 12 of an inner panel 11 of a vehicle, a cover 30 formed substantially in the shape of a rectangular cylinder which is made of synthetic resin, which is temporarily fitted inside the holder 20 with the cover substantially completely housed and which is provided so that the cover can be slid forward and backward, a pair of levers 40 and 40 which are made of synthetic resin and each base of which is supported by the cover 30 so that the base can be turned for engaging-or disengaging both male and female connector housings 50 and 60 described later by leverage, the male connector housing (one connector housing) 50 made of synthetic resin which is temporarily fitted inside the cover 30 with the male connector housing in a state waiting for engagement and which is provided so that the male connector housing can be reciprocated, being slid and the female connector housing (the other connector housing) 60 made of synthetic resin which is engaged or disengaged with/from the male connector housing 50 in a state waiting for engagement.

Also, as shown in FIGS. 1 to 3, the holder 20 is formed by upper and lower walls 20*a* and 20*b* and both side walls 20*c* and 20*c* formed substantially in the shape of a flat rectangular cylinder and the cover 30 is supported inside the holder 20 so that the cover can be slid. A stopper 21 perpendicularly extended outside is respectively integrally protruded at each of four corners at the rear end of an opening on the rear side of each wall 20*a,* 20*b* and 20*c* of the holder 20 and in each center at the rear end of the upper and lower walls 20*a* and 20*b,* and a flexible fitting portion 22 obliquely upward extended from the front side to the back side is integrally protruded on each of both sides of the upper and lower walls 20*a* and 20*b* of the holder 20. An aligning portion 24 is integrally protruded from each flexible fitting portion 22 via a slit 23 in the shape of reverse C so that the aligning portion is extended horizontally backward.

Figure 10:
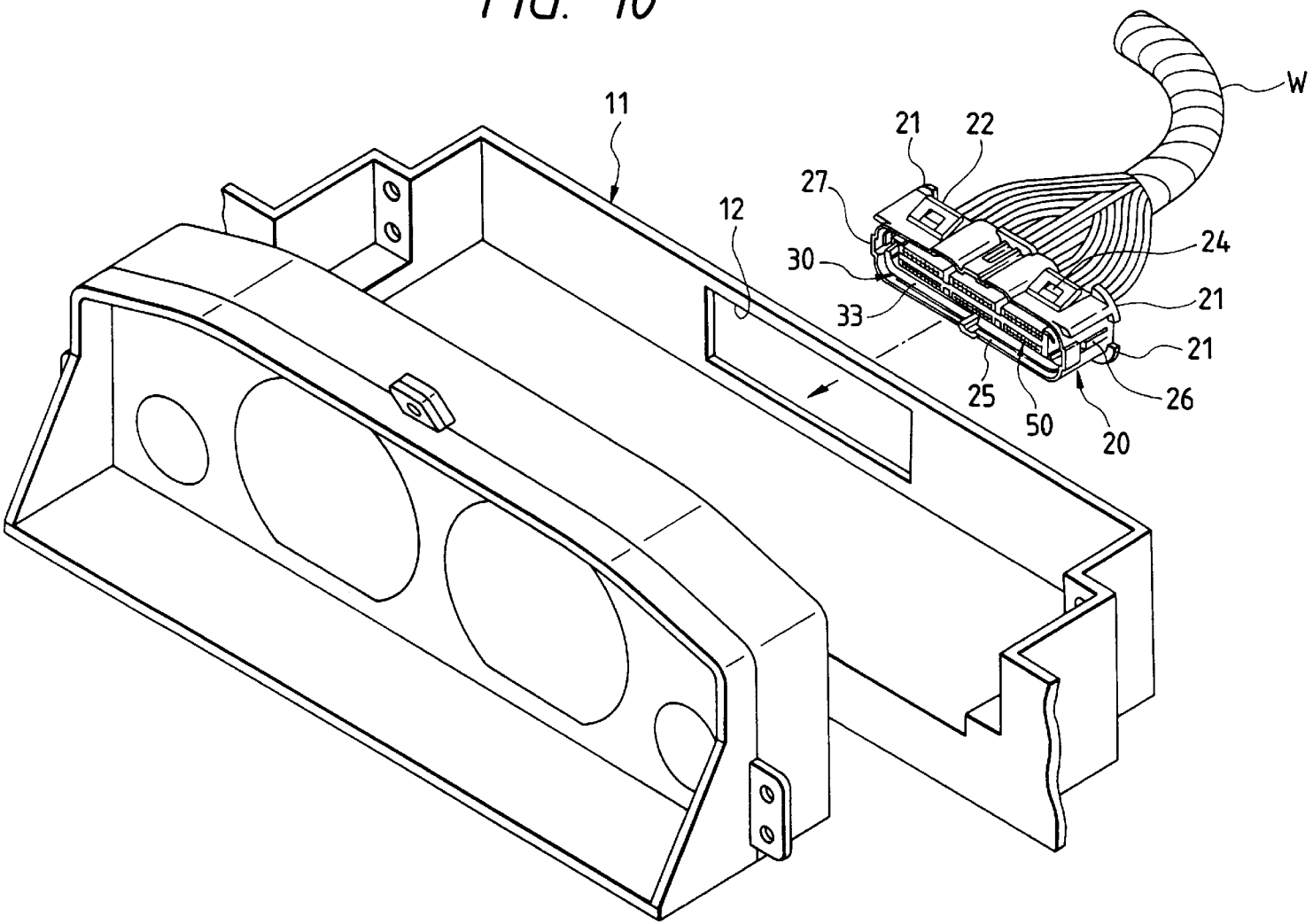
FIG. 10 is a perspective view showing a state before the connector is attached to an inner panel.
Figure 11:
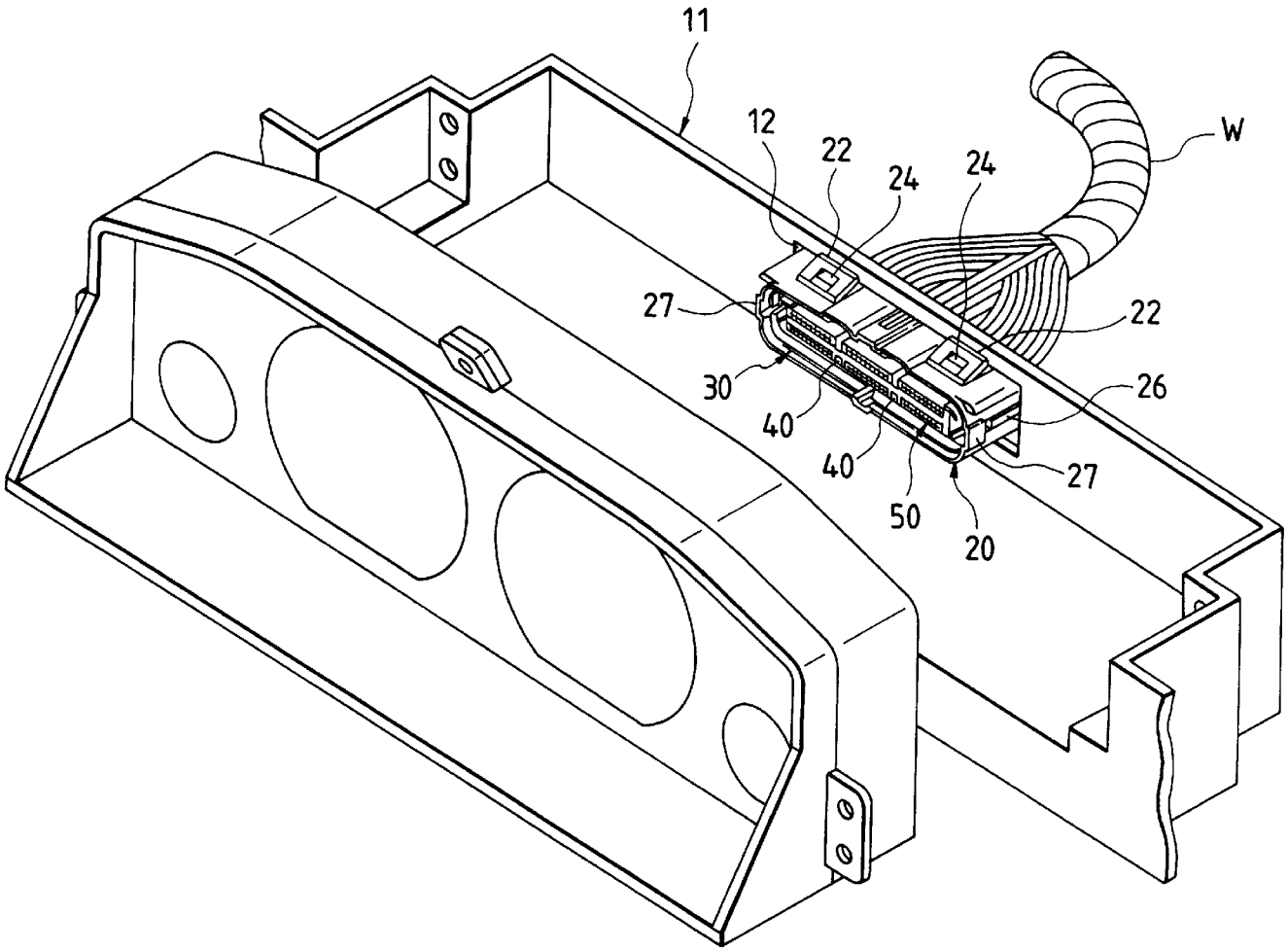
FIG. 11 is a perspective view showing a state in which the connector is attached to the inner panel.
Figure 12A:
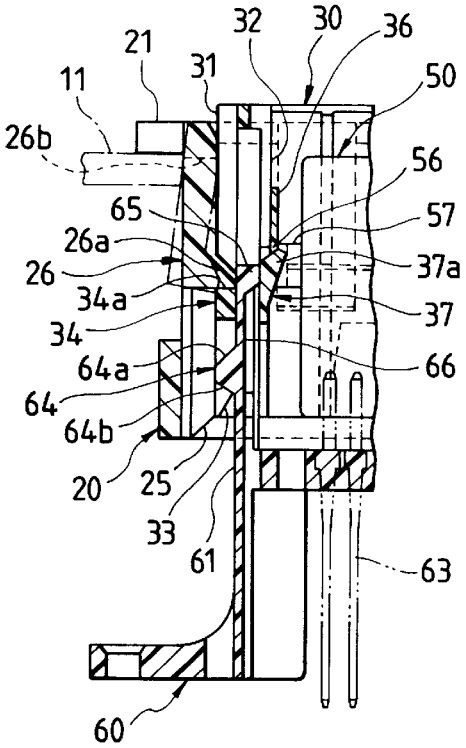
FIG. 12(*a*) is an explanatory view for explaining the initial state of engagement of the connector, FIG. 12(*b*) is an explanatory view for explaining a halfway state in which the connector is engaged, FIG. 12(*c*) is an explanatory view for explaining a state when the engagement of the connector is completed and FIG. 12(*d*) is an explanatory view for explaining an aligned state after the engagement of the connector is completed.
Figure 12B:
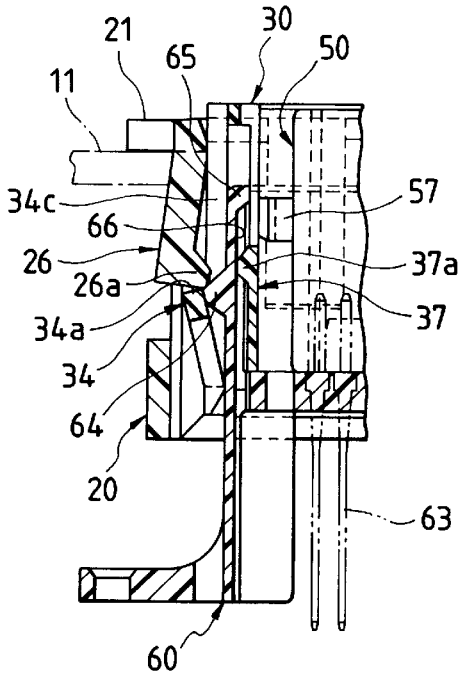
Figure 12C:
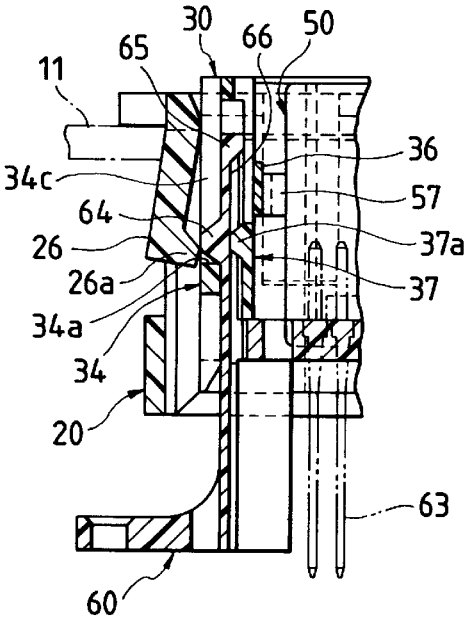
Figure 12D:
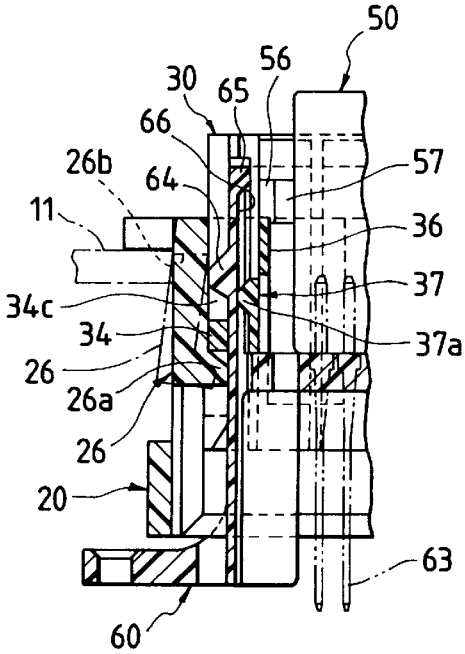

As shown in FIG. 2, a dimension between the respective aligning portions 24 of the upper and lower walls 20*a* and 20*b* of the holder 20 is set so that it is equal to the dimension in the direction of the height of the mounting hole 12 of the inner panel 11. When the holder 20 is inserted from the back of the mounting hole 12 of the inner panel 11 as shown in FIGS. 10 and 11 in a state shown in FIG. 1 in which the male connector housing 50 is temporarily fitted inside the cover 30 and the cover 30 is temporarily fitted inside the holder 20, each flexible fitting portion 22 is bent inside and the front and rear surfaces 11*a* and 11*b* in the vicinity of the mounting hole 12 of the inner panel 11 are fitted between each flexible fitting portion 22 and each stopper 21 so that the front and rear surfaces are respectively held between each flexible fitting portion and each stopper. At this time, as shown in FIG. 2, the upper and lower aligning portions 24 respectively integrated with the upper and lower flexible fitting portions 22 via each slit 23 are fitted into the mounting hole 12 in an elastic state.

Figure 5:
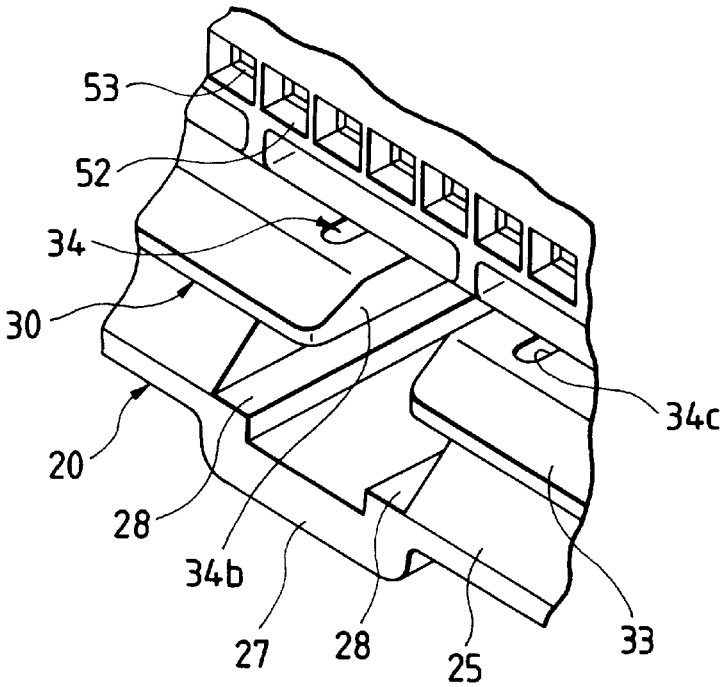
FIG. 5 is a perspective view showing the main part of the male connector housing.
Figure 7A:
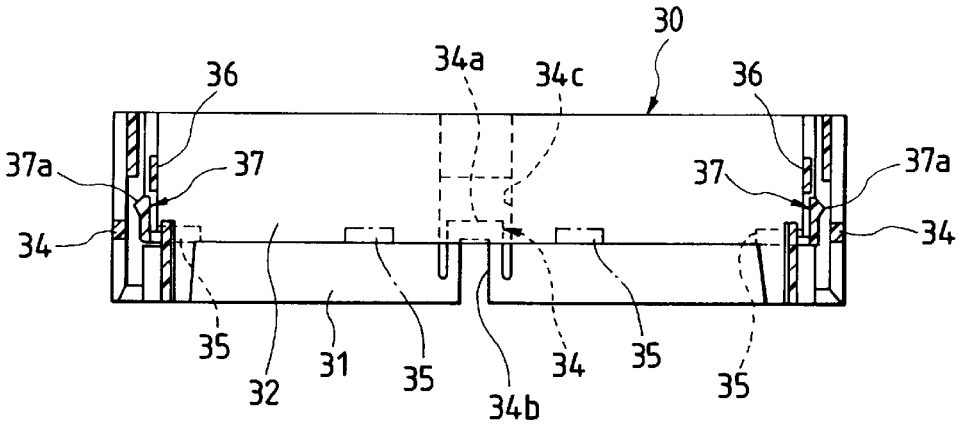
FIG. 7(*a*) is a sectional view showing a cover for holding the male connector housing, FIG. 7(*b*) is a side view showing the cover and FIG. 7(*c*) is a sectional view showing a holder for housing the cover.
Figure 7B:
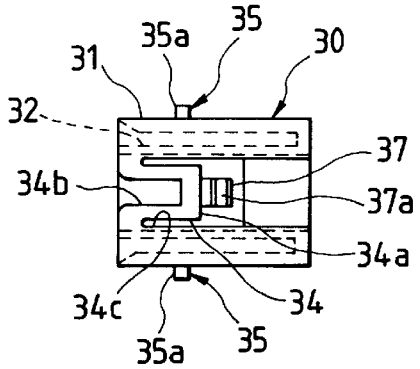
Figure 7C:
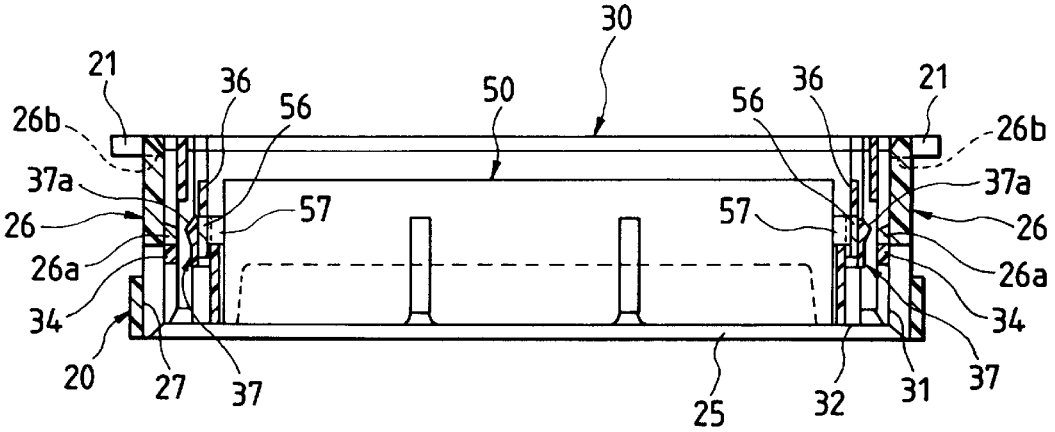

Also, as shown in FIGS. 1 to 3, a tapered surface 25 for guiding engagement with the female connector housing 60 is formed in the whole periphery of the front end (the end on the side with which the female connector housing 60 is engaged) of the opening on the front side of each wall 20*a*, 20*b*, 20*c* of the holder 20 and an L-type flexible arm (temporarily fitting means) 26 is integrated via a slit 26*b* in the shape of a letter C on the rear side from the center of each center of each wall 20*a,* 20*b* and 20*c* of the holder 20. As shown in FIG. 7(*c*), a protrusion (fitting portion) 26*a* the section of which is trapezoidal is integrally protruded inside the end of each flexible arm 26. Further, a concave portion 27 for preventing the holder from being opened is integrally protruded outside in the shape of reverse C in a position on the front side opposite to each flexible arm 26 of each wall 20*a*, 20*b* and 20*c* of the holder 20. As shown in FIGS. 1 and 5, a pair of recesses 28 and 28 for housing space when a flexible fitting piece 34 described later of the cover 30 is deformed are respectively formed from the front side to the center of the inner wall on both sides of each concave portion 27 of each wall 20*a*, 20*b* and 20*c* of the holder 20.

Figure 18:
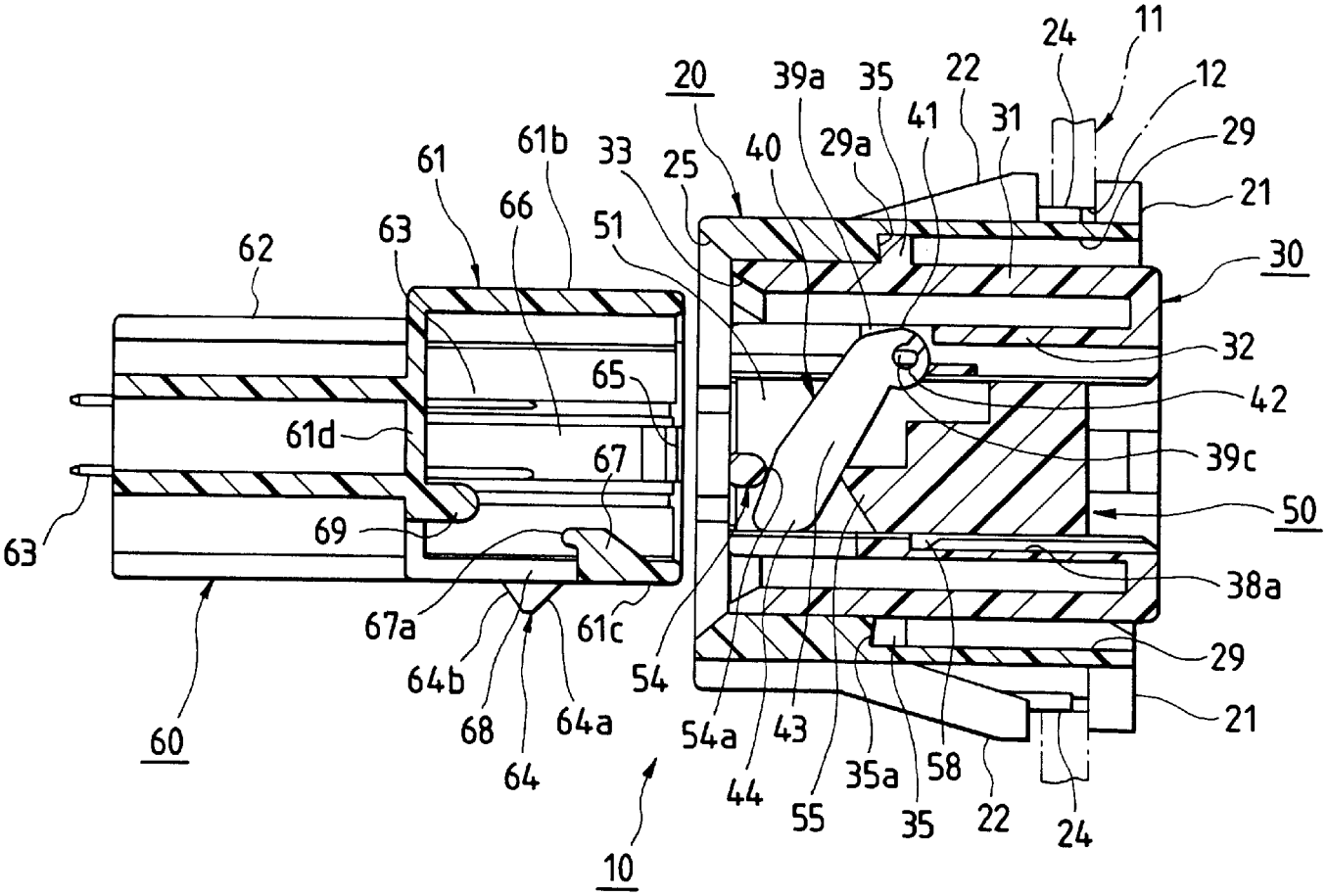
FIG. 18 is a sectional view showing a state after the connector is disengaged.

Further, as shown in FIGS. 3 and 4, a pair of guide grooves 29 and 29 are respectively formed in a rigid place on the side of the inner wall of the upper wall 20*a* of the holder 20 (in a reinforced portion in the vicinity of the lever on both sides of the concave portion 27 in the center) and in a rigid place on the side of the inner wall of the lower wall 20*b* (in the vicinity of the reinforced portion of the stopper 21 on both sides). As shown in FIGS. 2 and 18, a reversely tapered surface 29*a* is formed at the front end of each guide groove 29.

As shown in FIGS. 3 and 7, the cover 30 has double structure of an outer wall 31 formed substantially in the shape of a flat rectangular cylinder and an inner wall 32 formed substantially in the shape of a flat rectangular cylinder integrated with the outer wall 31, the hood 61 of the female connector housing 60 described later is housed between the outer wall 31 the front side of which is open and the inner wall 32, and the male connector housing 50 is temporarily fitted inside the inner wall 32 in a state waiting for engagement and can be slid inside the inner wall.

Figure 6:
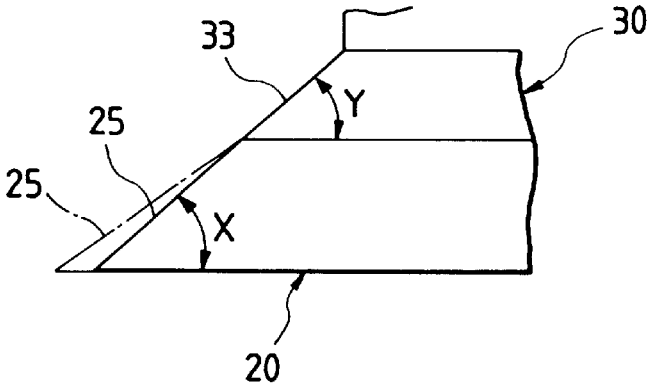
FIG. 6 is an explanatory view for explaining the main portion of the male connector housing.

As shown in FIGS. 1 to 3 and FIGS. 5 and 6, a tapered surface 33 for guiding engagement with the female connector housing 60 is formed in the whole periphery of the front end (the end on the side on which the female connector housing 60 is engaged) of the opening on the front side of the outer wall 31 of the cover 30. The tapered surface 33 of the cover 30 and the tapered surface 25 of the holder 20 are respectively formed so that they are on the substantially same plane (the end surface on which the tapered surface 33 of the cover 30 starts is the same as the end of the tapered surface 25 of the holder 20 or is a little backward) when the flexible arm 26 of the holder 20 and the temporarily fitting means 34 described later of the cover 30 are temporarily fitted. That is, as shown in FIG. 6, if the cone angle of the tapered surface 25 of the holder 20 is X and the cone angle of the tapered surface 33 of the cover 30 is Y, each of the tapered surfaces 25 and 33 is formed so that Y≧X.

As shown in FIGS. 3, 7(*a*), 7(*b*) and 7(*c*), the temporarily fitting means 34 for holding a state waiting for engagement of the male connector housing 50 is integrated in the center on the front side of the upper and lower walls of the outer wall 31 of the cover 30 and in the center on the front side of walls on both sides. The temporarily fitting means 34 is composed of a flexible fitting piece in the shape of reverse C which is engaged or disengaged with/from the protrusion 26*a* of each flexible arm 26 of the holder 20. That is, each flexible fitting piece 34 as temporarily fitting means is elastically deformed outside in a concave portion 34*b* in the center and a notch 34*c* formed substantially in the shape of reverse C and the protrusion 26*a* of each flexible arm 26 of the holder 20 can be engaged or disengaged with/from the side of the end surface 34*a*.

Further, as shown in FIGS. 2, 3 and 4, a stopper convex portion 35 is integrally protruded in a position opposite to each guide groove 29 of the holder 20 outside the outer wall 31 of the cover 30. A reversely tapered surface 35*a* in the same direction as the reversely tapered surface 29*a* at the front end of each guide groove 29 of the holder 20 is formed on the front side of each stopper convex portion 35 and in a state waiting for engagement of the male connector housing 50, the reversely tapered surface 29*a* at the front end of each guide groove 29 of the holder 20 and the reversely tapered surface 35*a* of each stopper convex portion 35 of the cover 30 can be touched.

Figure 8A:
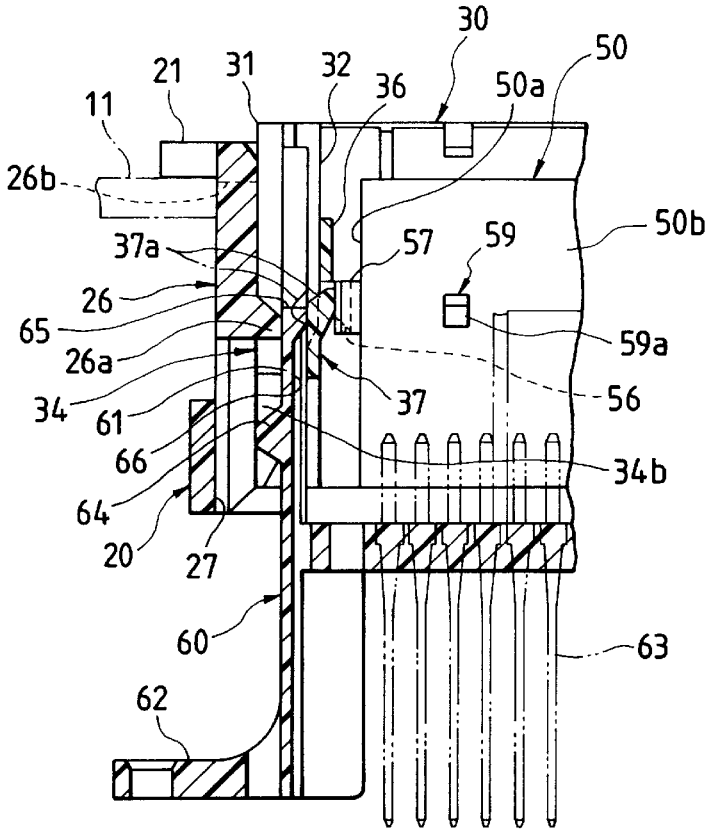
FIG. 8(*a*) is a sectional view showing the main part at the beginning of the engagement of the male and female connector housings and FIG. 8(*b*) is a sectional view showing the main part after the engagement of the connector housings is completed.
Figure 8B:
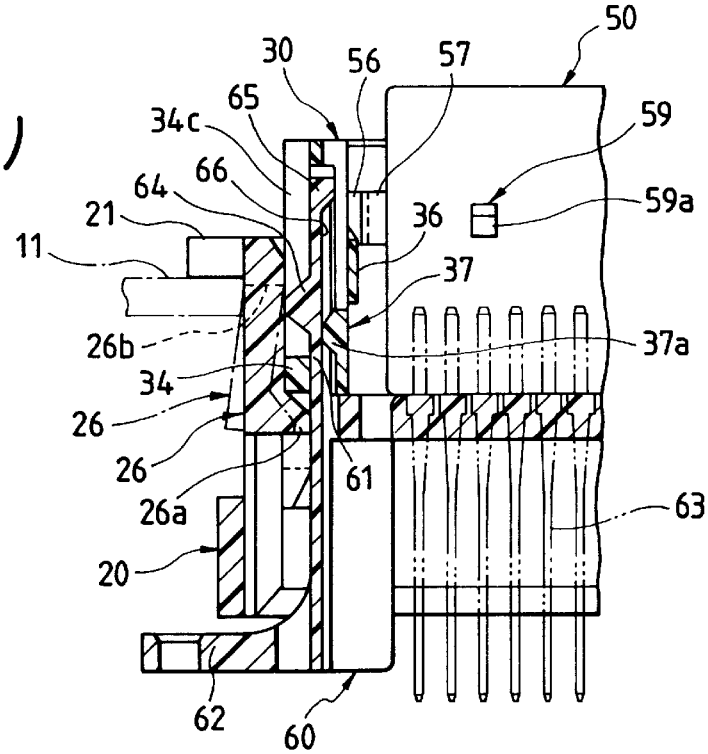

As shown in FIGS. 7(*a*), 7(*b*) and 7(*c*), a temporarily fitting stopper 36 is integrated in the center of the wall on both sides of the inner wall 32 of the cover 30. A temporary fitting locking portion 56 of the male connector housing 50 described later in a state waiting for engagement is temporarily fitted to each temporarily fitting stopper 36. A flexible temporary fitting releasing arm 37 provided with a convex portion 37*a* outside the end is integrated in a front position outside the temporarily fitting stopper 36 in the center on the front side of the wall on both sides of the inner wall 32 of the cover 30. The flexible temporary fitting releasing arm 37 is bent inside by a temporary fitting releasing convex portion 65 of the female connector housing 60 described later as shown in FIG. 8(*a*), the temporary fitting locking portion 56 of the male connector housing 50 is pressed inside by the flexuous deformation of the temporary fitting releasing arm 37 and a state in which each temporarily fitting stopper 36 and the temporary fitting locking portion 56 of the male connector housing 50 are temporarily fitted is released.

Also, as shown in FIGS. 3, 7(*a*), 7(*b*) and 7(*c*), the center on the front side of the upper and lower walls of the inner wall 32 of the cover 30 is notched, and the upper and lower walls of the inner wall 32 of the cover 30 are formed in size in which they can substantially completely wrap the male connector housing 50 in a state waiting for engagement. Further, plural guide grooves 38*a* and 38*b* are respectively formed in the vicinity of a position in which the cover 30 is in the shape of reverse C and is hard to be deformed and on the rigid inner side of the upper and lower walls of the inner wall 32 near to the lever. As shown in FIG. 4, a pair of lever relief grooves 39*a* and 39*a* and a pair of lever relief grooves 39*b* and 39*b* are formed on both sides near to the center between the upper and lower walls of the inner wall 32 of the cover 30 and a lever 40 is arranged between the lever relief grooves 39*a* and 39*b* and between the lever relief grooves 39*a* and 39*b*.

As shown in FIGS. 3 and 4, each lever 40 is formed by synthetic resin substantially in the shape of a rectangular plate and a supporting hole 42 is formed in the center of its base 41 in the shape of a circular arc. The base 41 of the lever 40 is supported so that it can be turned by fitting a spindle 39*c* protruded in each lever relief groove 39*a* on the side of the upper wall of the inner wall 32 of the cover 30 into the supporting hole 42 as shown in FIG. 18.

As shown in FIG. 3, the male connector housing 50 is formed substantially in the shape of a rectangular parallelopiped made of synthetic resin provided with a pair of lever relief grooves 51 and 51 from the front side to the rear side and plural terminal housing chambers 52 are formed between the front side and the rear side. A female terminal 53 which is electrically connected to each male terminal 63 of the female connector housing 60 described later when both connector housings 50 and 60 are engaged for electrically connecting both connector housings 50 and 60 is housed in each terminal housing chamber 52. A wire harness W shown in FIGS. 10 and 11 is connected to each female terminal 53.

A guide bar (point of application) 54 as a lever hooking portion is integrally protruded on the front side of each lever relief groove 51 of the male connector housing 50. The guide bar 54 is provided with a circular arc surface 54*a* functioning as the point of application of the lever 40 by sliding the side of the halfway portion 43 of the lever 40 as shown in FIG. 18. Further, a lever extruding portion 55 formed substantially in the shape of a trapezoid with which the halfway portion 43 of the lever 40 comes in contact and is slid in a state waiting for engagement of the male connector housing 50 is integrally protruded on the rear side on one side of each lever relief groove 51 of the male connector housing 50. An interval between these guide bar 54 and lever extruding portion 55 is set to be small so that it is substantially equal to the width of the halfway portion 43 of the lever 40 as shown in FIG. 18.

Further, the temporary fitting locking portion 56 the section of which is trapezoidal and which is temporarily fitted to the temporarily fitting stopper 36 of the cover 30 in a state waiting for engagement of the male connector housing 50 is provided on the rear side of both sides 50*a* and 50*a* of the male connector housing 50. The temporary fitting locking portion 56 is integrated with each flexible arm 57 integrally protruded in the shape of reverse C from both sides 50*a* and 50*a* and is provided with a tapered surface 56*a* on the front side. Stopper convex portions 58 and 59 respectively slid in the guide grooves 38*a* and 38*b* are integrally protruded in positions opposite to the guide groove 38*a* and 38*b* of the inner wall 32 of the cover 30 on the upper and lower surfaces 50*b* and 50*c* of the male connector housing 50. One stopper convex portion 58 regulates sliding in the front portion of the male connector housing 50, the other stopper convex portion 59 regulates sliding in the rear portion of the male connector housing 50 and tapered surfaces 58*a* and 59*a* are formed in opposite positions.

Figure 9:
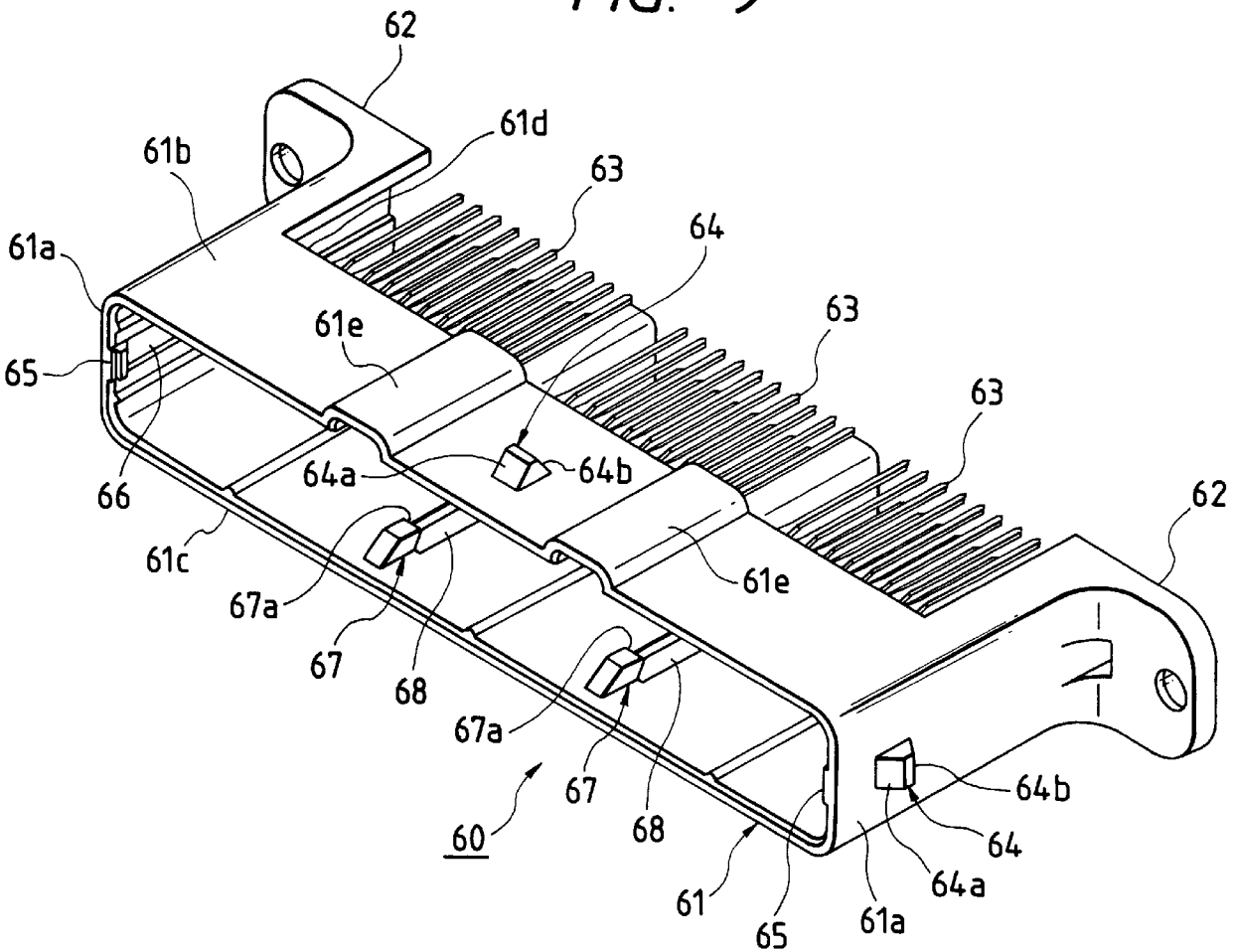
FIG. 9 is a perspective view showing the female connector housing viewed from the front side.

As shown in FIGS. 1 and 9, in the female connector housing 60, plural male terminals 63 are exposed among the hood 61 in the shape of a rectangular cylinder and L-type both legs 62 and 62, the hood 61 is inserted between the outer wall 31 and the inner wall 32 of the cover 30 when both connector housings 50 and 60 are engaged and each terminal 53 and 63 of both connector housings 50 and 60 are electrically connected.

Also, as shown in FIGS. 1 and 9, a protrusion 64 also functioning as holding means for holding the temporarily fitted state of the protrusion 26*a* of each flexible arm 26 of the holder 20 and each flexible fitting piece 34 of the cover 30 and as releasing means for releasing the temporarily fitted state of the protrusion 26*a* of each flexible arm 26 of the holder 20 and each flexible fitting piece 34 of the cover 30 when the engagement of both connector housings 50 and 60 is completed and when they are disengaged is integrally protruded in the center on the front side of the outer surfaces of both side walls 61*a* and 61*a* of the hood 61 of the female connector housing 60 and in the center on the front side of the outer surfaces of the upper and lower walls 61*b* and 61*c*. The protrusion 64 is formed substantially in the shape of a triangle pole, the front side has a tapered surface (fitting surface) 64*a* and the rear side also has a tapered surface (disengaging surface) 64*b*.

Further, as shown in FIGS. 8(*a*), 8(*b*) and 9, the temporary fitting releasing convex portion 65 the section of which is formed substantially in the shape of a trapezoid for touching or separating to/from the convex portion 37*a* of the temporary fitting releasing arm 37 of the cover 30 is integrally protruded at each front end of the inner surfaces of both side walls 61*a* and 61*a* of the hood 61 of the female connector housing 60. A relief groove 66 for housing and guiding the convex portion 37*a* of the temporary fitting releasing arm 37 of the cover 30 is formed in each center of the inner surfaces of both side walls 61*a* and 61*a* of the hood 61.

As shown in FIGS. 9 and 18, a rib (fitting portion) 67 is integrally protruded on both sides of the inner surface of the lower wall 61*c* of the hood 61 of the female connector housing 60. A protrusion 67*a* to which the end 44 of the lever 40 is slid is integrally protruded at the upper end of the rear surface of the rib 67. The end 44 of the lever 40 is touched to the protrusion 67*a* by being slid and functions as the fulcrum of the lever 40 when the hood 61 of the female connector housing 60 is inserted between the outer wall 31 and the inner wall 32 of the cover 30, being slid, the female connector housing 60 is pulled into the male connector housing 50 and both connector housings 50 and 60 are engaged or disengaged. Further, a lever relief groove 68 is formed from the back of the rib 67 on the lower wall 61*c* of the hood 61 to a vertical partition wall 61*d* and a lever extruding portion 69 to which the halfway portion 43 of the lever 40 is touched is integrally protruded on the lower side of the partition wall 61*d*.

As shown in FIGS. 1 and 4, each guide groove 29 on both sides of the upper wall 20*a* of the holder 20 is formed in a position protruded upward, and convex portions 31*e*, 32*e* and 61*e* respectively upward protruded are respectively formed in a position on the side of the upper wall of the outer wall 31 and the inner wall 32 of the cover 30 opposite to the convex portion 20*e* and on the side of the upper wall 61*b* of the hood 61 of the female connector housing 60.

According to the connector 10 of the above embodiment, as shown in FIGS. 10 and 11, when the holder 20 is inserted and pressed from the back of the mounting hole 12 of the inner panel 11 in case the male connector housing 50 on the side of the wire harness W is mounted in the mounting hole 12 of the inner panel 11 via the holder 20, the front and rear surfaces 11*a* and 11*b* of the inner panel 11 are held and fixed between upper and lower each flexible fitting portion 22 of the holder 20 and upper and lower and right and left each stopper 21. At the time of this engagement, as shown in FIG. 2, alignment is made (the holder and others are positioned in the central position of the mounting hole 12) by bumping upper and lower each aligning portion 24 of the holder 20 against the end surface of the mounting hole 12 of the inner panel 11 and by bending each aligning portion 24 even if the holder 20 is moved upward, downward, rightward or leftward in the mounting hole 12, the holder and others are securely engaged and fixed. As the holder and others also try to approach the center of the mounting hole 12 because of the elastic effect of each aligning portion 24 of the holder 20 after engagement, width in which the flexible fitting portion 22 and the inner panel 11 are engaged is kept fixed, the holding power of the whole connector 10 when the connector is fixed to the inner panel 11 can be increased and space for attaching the connector to the inner panel 11 can be reduced.

After the male connector housing 50 is attached into the mounting hole 12 of the inner panel 11 via the holder 20, the female connector housing 60 is engaged with the male connector housing 50 in a state waiting for engagement. Explaining the engagement of these male and female connector housings 50 and 60, referring to FIGS. 12(*a*) to 12(*d*), in the engagement initial state of both connector housings 50 and 60 in which the hood 61 of the female connector housing 60 is inserted between the outer wall 31 and the inner wall 32 of the cover 30 as shown in FIG. 12(*a*), a state waiting for engagement of the male connector housing 50 is kept by the temporarily fitted state of the protrusion 26*a* of each flexible arm 26 of the holder 20 and the end surface 34*a* of each flexible fitting piece 34 of the cover 30. When the hood 61 of the female connector housing 60 is inserted between the outer wall 31 and the inner wall 32 of the cover 30, the hood 61 of the female connector housing 60 can be smoothly led to the side of the male connector housing 50 by the tapered surface 25 of the holder 20 and the tapered surface 33 of the cover 30. Hereby, the end on the engaged side of the hood 61 of the female connector housing 60 bumps against each front end of the holder 20 and the cover 30, and the temporarily fitted state of the protrusion 26*a* of each flexible arm 26 of the holder 20 and the end surface 34*a* of each flexible fitting piece 34 of the cover 30 does never come off.

When both connector housings 50 and 60 begin to be engaged, the temporary fitting releasing convex portion 65 of the hood 61 of the female connector housing 60 bumps against the convex portion 37*a* of the flexible temporary fitting releasing arm 37 of the cover 30 as shown in FIG. 12(*a*) and the temporary fitting releasing arm 37 is bent inside, the temporary fitting locking portion 56 of the male connector housing 50 is pressed inside. Hereby, the flexible arm 57 of the male connector housing 50 is bent inside, the temporary fitting lock of the temporary fitting locking portion 56 and the temporarily fitting stopper 36 of the cover 30 is released and the male connector housing 50 is slid backward inside the inner wall 32 of the cover 30. As the convex portion 37*a* of the flexible temporary fitting releasing arm 37 of the cover 30 is put in the relief groove 66 of the hood 61 of the female connector housing 60 as shown in FIG. 12(*c*) when engagement is completed, the temporary fitting releasing arm 37 is restored to an original state.

Next, as shown in FIG. 12(*b*), during the engagement of both connector housings 50 and 60, each flexible fitting piece 34 of the cover 30 is elastically deformed outside by the pressure of each protrusion 64 of the female connector housing 60, the end surface 34*a* of each flexible fitting piece 34 of the cover 30 bumps against the end surface of each flexible arm 26 of the holder 20 and the temporarily fitted state of the protrusion 26*a* of each flexible arm 26 of the holder 20 and the end surface 34*a* of each flexible fitting piece 34 of the cover 30 is more securely maintained.

As shown in FIG. 12(*c*), when the engagement of both connector housings 50 and 60 is completed, each protrusion 64 of the female connector housing 60 is put in the notch 34*c* in the back of each flexible fitting piece 34 of the cover 30. At this time, the tapered surface 64*a* of each protrusion 64 of the female connector housing 60 presses the protrusion 26*a* of each flexible arm 26 of the holder 20 outside and each flexible arm 26 is elastically deformed outside and bent. Hereby, as shown in FIGS. 12(*c*) and 12(*d*), the temporarily fitted state of the protrusion 26*a* of each flexible arm 26 of the holder 20 and the end surface 34*a* of each flexible fitting piece 34 of the cover 30 is released and both connector housings 50 and 60 the engagement of which is respectively completed are both slid backward inside the cover. When the above sliding is completed, the connector 10 is in an aligned state as shown in FIGS. 12(*d*) and 13.

Figure 15:
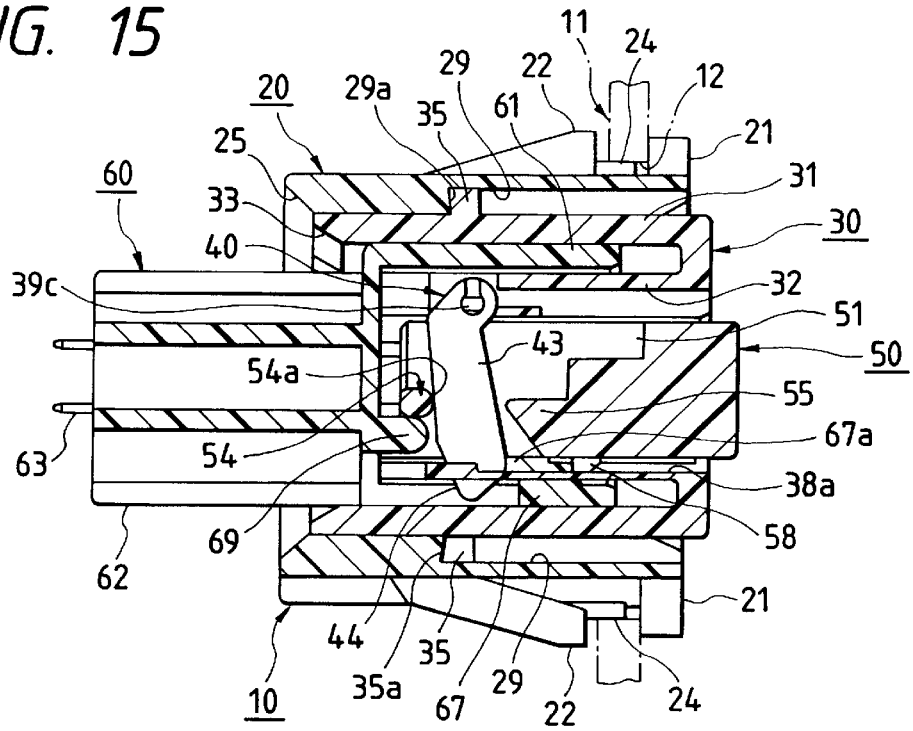
FIG. 15 is a sectional view showing a halfway state in which the connector is disengaged.
Figure 16:
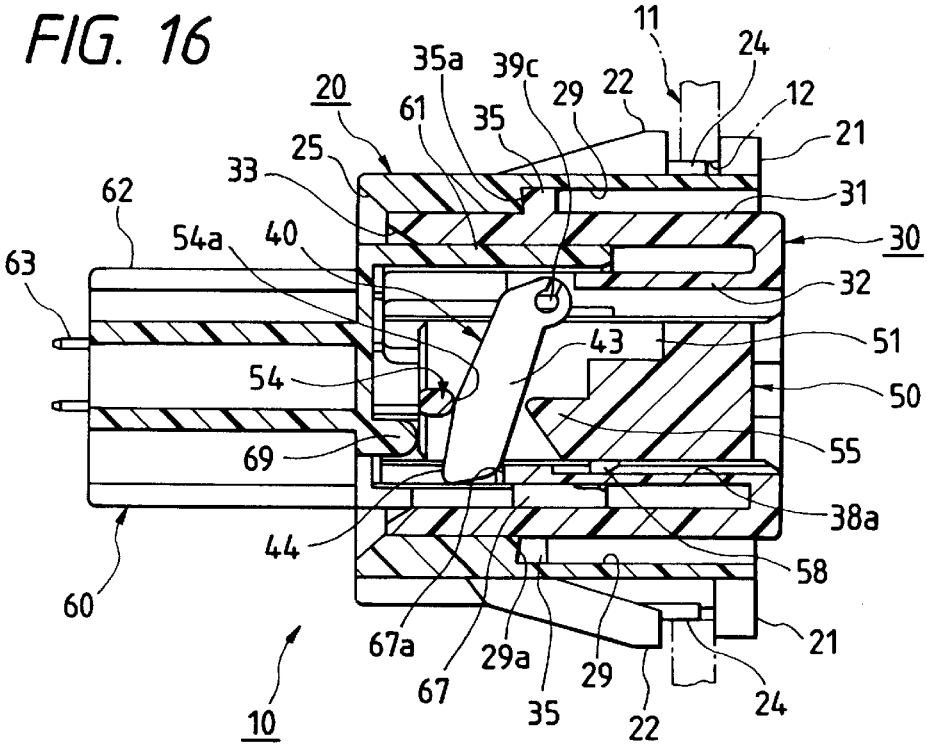
FIG. 16 is a sectional view showing another halfway state in which the connector is disengaged.
Figure 17:
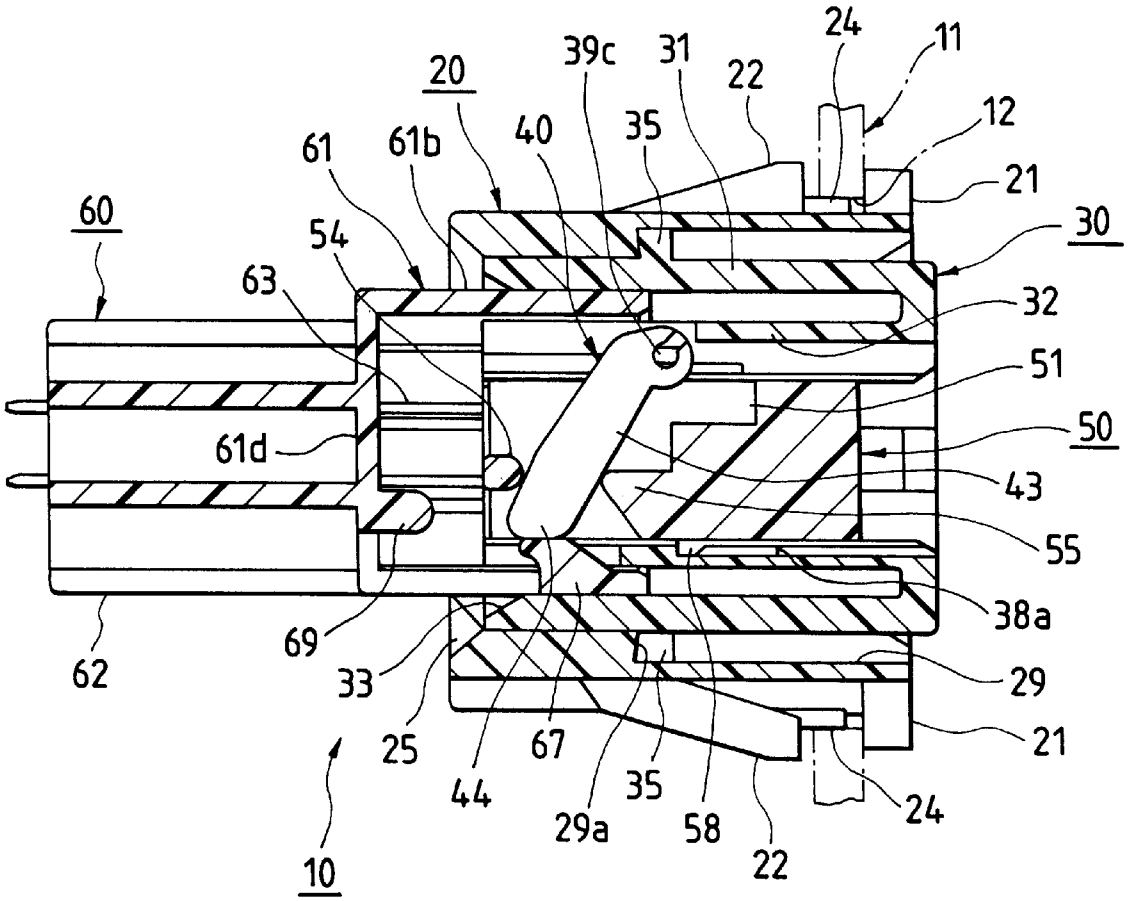
FIG. 17 is a sectional view showing a state in which terminals are disengaged while the connector is disengaged.

Explaining a process from the engagement initial state of both connector housings 50 and 60 to the engagement completed state concerning relation to the lever 40, when the hood 61 of the female connector housing 60 is inserted between the outer wall 31 and the inner wall 32 of the cover 30 as shown in FIG. 17 and the female connector housing 60 is pushed in a direction in which both connector housings 50 and 60 are engaged, the end 44 of the lever 40 is touched to the protrusion 67*a* for the fulcrum of the lever of the rib 67 inside the hood 61 of the female connector housing 60 as shown in FIG. 16 and the lever 40 begins to be turned. As shown in FIG. 15, when the female connector housing 60 is further pushed in the direction of engagement, the hood 61 of the female connector housing 60 is pulled between the outer wall 31 and the inner wall 32 of the cover 30 by the leverage of the lever 40 (leverage with the spindle 39*c* for supporting the base 41 of the lever 40 so that the base can be turned as a point where force is applied, the circular arc surface 54*a* of the guide bar 54 of the male connector housing 50 as a point of application and the protrusion 67*a* of the rib 67 of the female connector housing 60 as a fulcrum) and both connector housings 50 and 60 are engaged. As a result, both connector housings 50 and 60 can be readily engaged by the leverage of the lever 40 only by sliding the female connector housing 60 with small force in the direction of engagement.

Figure 13:
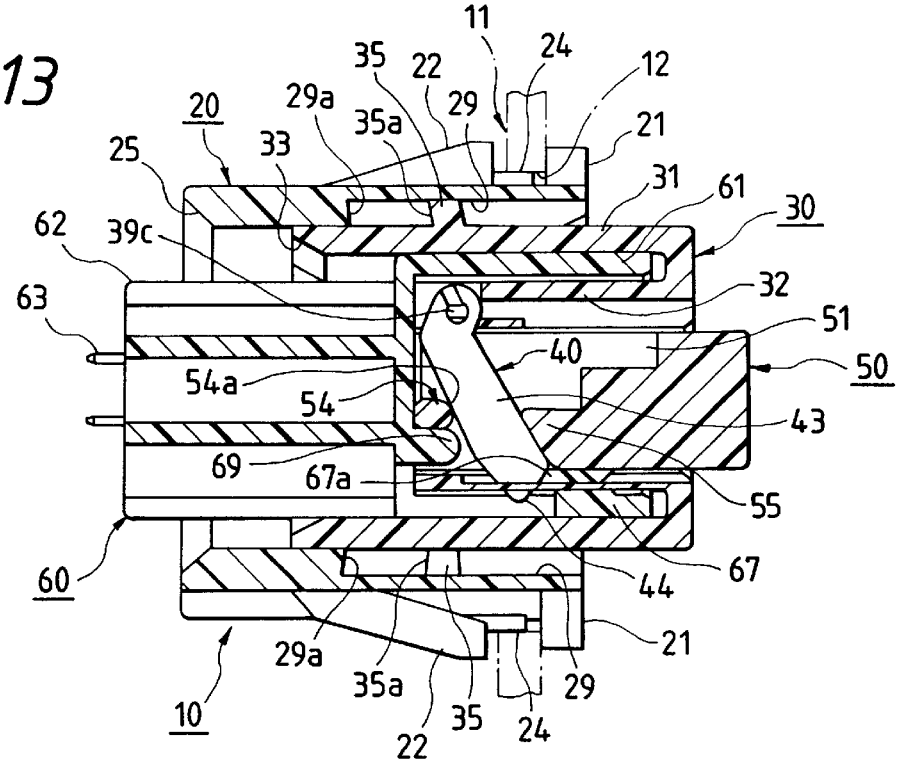
FIG. 13 is a sectional view showing an aligned state after the connector is completely engaged.
Figure 14:
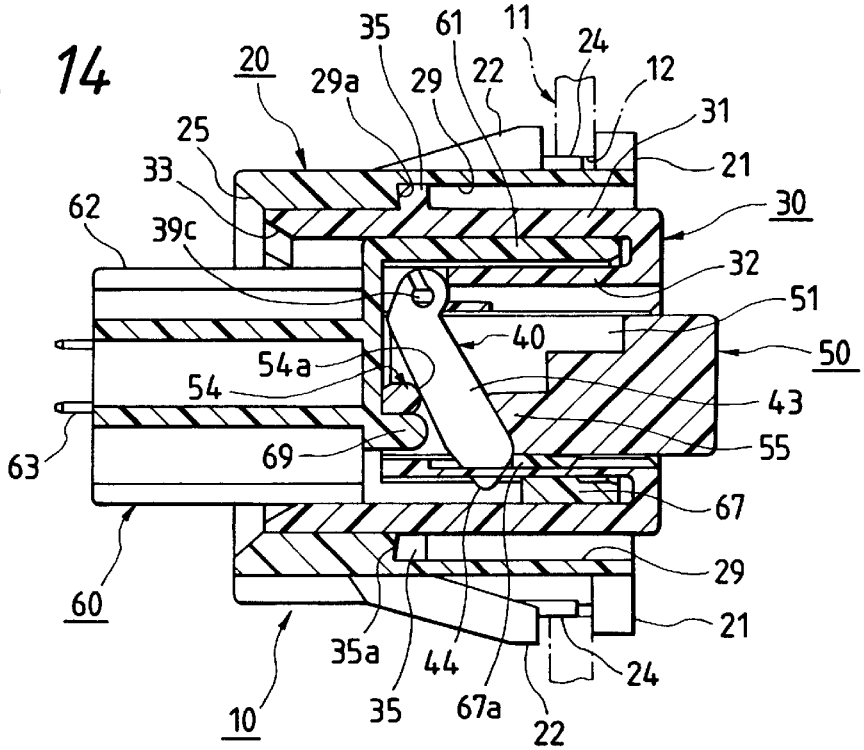
FIG. 14 is a sectional view showing a state in which the connector is completely engaged.

For maintenance, checking and others, in case both connector housings 50 and 60 are disengaged from the completely engaged state shown in FIGS. 13 and 14 of both connector housings 50 and 60, they are operated as shown in FIGS. 13 to 17. That is, between the start of the disengagement of both connector housings 50 and 60 shown in FIG. 14 and the disengagement of female and male terminals 53 and 63 shown in FIG. 17, the end 44 of the lever 40 is touched to the protrusion 67*a* for the fulcrum of the lever of the rib 67 inside the hood 61 of the female connector housing 60, the lever 40 is turned in a reverse direction to the time of engagement and both connector housings are disengaged, pulling in the guide bar 54 of the male connector housing 50. Simultaneously when the rib 67 inside the hood 61 of the female connector housing 60 escapes under the end 44 of the lever 40 in a state shown in FIG. 17, the disengagement of the female and male terminals 53 and 63 is completed. As a result, both connector housings 50 and 60 can be readily disengaged by the leverage of the lever 40 only by sliding the female connector housing 60 in the direction of disengagement with small force.

Figure 19:
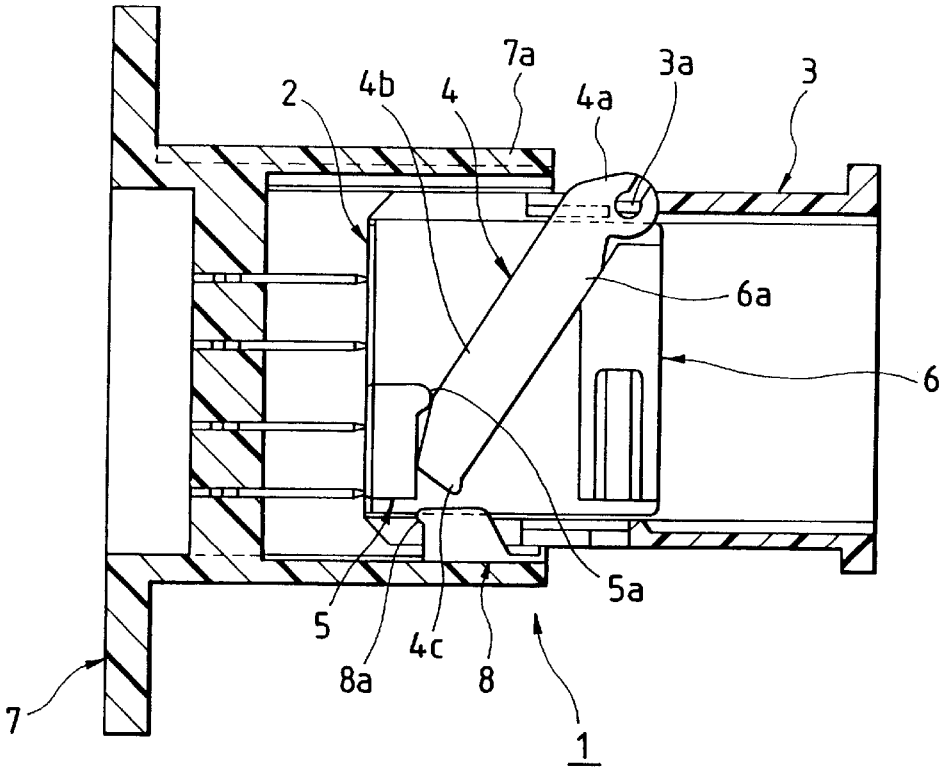
FIG. 19 is a sectional view showing a state immediately before a connector according to the related art is engaged.
Figure 20:
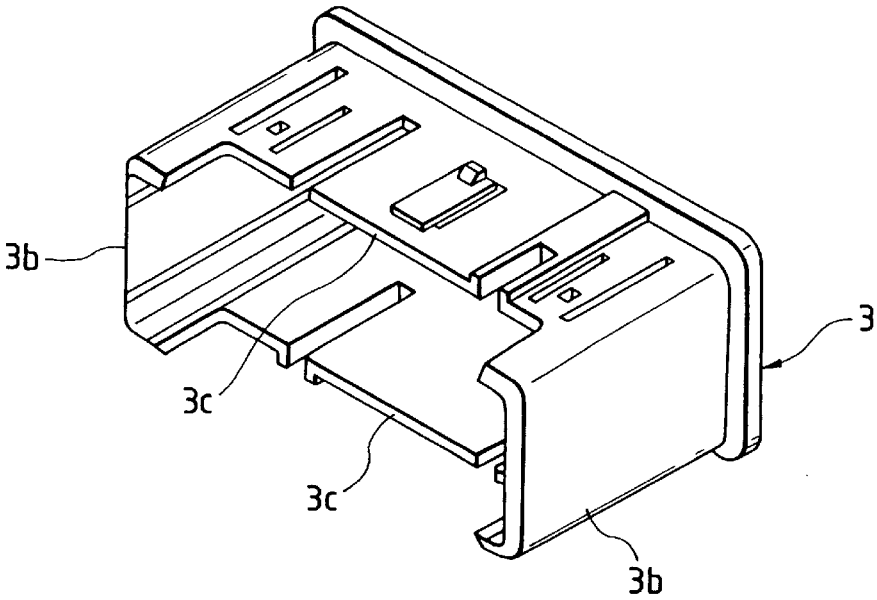
FIG. 20 is a perspective view showing a slide cover used for the connector according to the related art.

As described above, as an interval between the guide bar 54 of the male connector housing 50 and the lever extruding portion 55 is set so that it is smaller (as shown in FIGS. 14 to 17) than the interval according to the related art (as shown in FIG. 19) both connector housings 50 and 60 can be smoothly and securely engaged or disengaged by the leverage of the lever 40 with small force when both connector housings 50 and 60 are engaged or disengaged. As shown in FIG. 14, as the halfway portion 43 of the lever 40 is held among the lever extruding portion 69 integrally protruded from the female connector housing 60, the guide bar 54 of the male connector housing 50 and the lever extruding portion 55 of the male connector housing 50 when both connector housings 50 and 60 are engaged, the engaged state of both connector housings 50 and 60 can be securely held.

As described above, according to the present invention, as an interval between the point of application of one connector housing and the lever extruding portion is set to be small so that it is substantially equal to the width of the halfway portion of the lever, both connector housings can be smoothly and securely engaged or disengaged by the leverage of the lever by small force when the connector housings are engaged or disengaged.

What is claimed is:

1. A connector comprising:

a first connector housing;

a second connector housing which engages said first connector housing;

a cover in which said first connector housing is provided; and a lever including a base, a halfway portion, and an end portion, said base portion being pivotally supported by said cover, wherein said first connector housing includes a guide bar and a first lever extruding portion defining a space therebetween which receives said lever at a vicinity of said halfway portion, and wherein a width of the space is at least as large as a width of said lever at the vicinity of said halfway portion.

2. The connector according to claim 1, further comprising a second lever extruding portion which contacts the halfway portion of said lever and protrudes from said second connector housing.

3. The connector according to claim 1, wherein said second connector housing further comprises a rib which contacts said end portion of said lever to engage said first and second connector housings.

4. The connector according to claim 1, wherein said second connector housing further comprises a rib which contacts said end portion of said lever to disengage said first and second connector housings.

5. The connector according to claim 1, wherein said cover receives said first and second connector housings therein.

6. A connector comprising:

a first connector housing;

a second connector housing which engages said first connector housing;

a cover in which said first connector housing is provided; and a lever including a base, a halfway portion, and an end portion, said base portion being pivotally supported by said cover, wherein said first connector housing includes a guide bar and a lever extruding portion disposed on opposing sides of said lever at a corresponding distance from said base portion in a direction of said end portion and disposed proximate to said halfway portion of said lever, wherein said lever is positioned between said guide bar and said lever extruding portion which act as leverage points for said lever.

* * * * *